United States Patent [19]

Hutchings et al.

[11] 4,358,365

[45] Nov. 9, 1982

[54] CONVERSION OF ASPHALTENE-CONTAINING CHARGE STOCKS

[75] Inventors: LeRoi E. Hutchings, Mt. Prospect; Algie J. Conner, Downers Grove, both of Ill.

[73] Assignee: UOP Inc., Des Plaines, Ill.

[21] Appl. No.: 257,042

[22] Filed: Apr. 24, 1981

[51] Int. Cl.[3] ..... C10G 67/04

[52] U.S. Cl. ..... 208/96; 208/309

[58] Field of Search ..... 208/86, 96, 309

[56] References Cited

U.S. PATENT DOCUMENTS

| | | | |
|---|---|---|---|
| 2,081,473 | 5/1937 | Bray et al. | 196/13 |
| 2,882,219 | 4/1959 | Johnson | 208/86 |
| 3,165,463 | 1/1965 | Gleim et al. | 208/264 |
| 3,168,459 | 2/1965 | Anderson et al. | 208/57 |
| 3,558,474 | 1/1971 | Gleim et al. | 208/108 |
| 3,645,887 | 2/1972 | Mounce | 208/96 |
| 3,723,294 | 3/1973 | Gatsis et al. | 208/86 |
| 3,723,297 | 3/1973 | Gatsis et al. | 208/95 |
| 3,998,726 | 12/1976 | Bunas et al. | 208/309 |

*Primary Examiner*—Aaron Weisstuch
*Assistant Examiner*—William Leader
*Attorney, Agent, or Firm*—James R. Hoatson, Jr.; John G. Cutts; William H. Page, II

[57] ABSTRACT

A process for the conversion of an asphaltene-containing, hydrocarbonaceous black oil in a catalytic slurry reaction zone wherein an admixture of converted hydrocarbonaceous oil and unconverted asphaltenes is recycled to the reaction zone.

8 Claims, 1 Drawing Figure

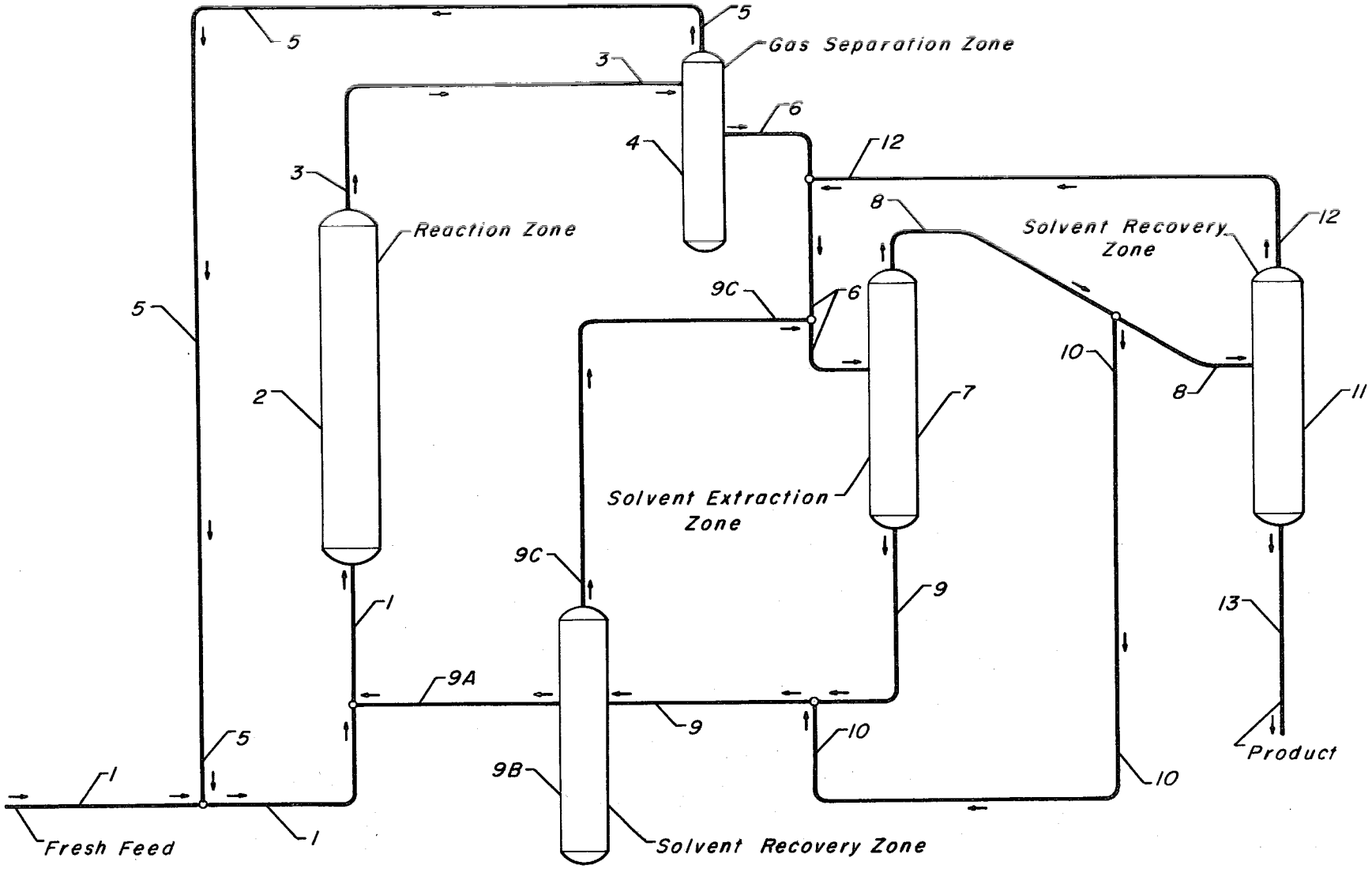
Gas Separation Zone
Solvent Recovery Zone
Reaction Zone
Solvent Extraction Zone
Solvent Recovery Zone
Product
Fresh Feed
1
2
3
4
5
6
7
8
9
9A
9B
9C
10
11
12
13

CONVERSION OF ASPHALTENE-CONTAINING CHARGE STOCKS

BACKGROUND OF THE INVENTION

The present invention relates to a process for effecting the decontamination, or hydrorefining, of petroleum crude oil, heavy vacuum gas oil, crude tower bottoms, tar sands oil, coal oil extracts, vacuum tower bottoms product, visbreaker product effluent, heavy cycle stocks, and other high-boiling hydrocarbon fractions and/or distillates commonly referred to in the petroleum art as "black oils". More specifically, the present invention is directed toward a catalytic, slurry-type process for hydrorefining heavy hydrocarbonaceous material severely contaminated by the inclusion of excessive quantities of deleterious substances.

In one of its embodiments, the present invention involves a process for effecting the decontamination, or hydrorefining, of a heavy hydrocarbon charge stock for the primary purpose of effecting the destructive removal of a significant amount of nitrogenous and sulfurous compounds, and particularly for the conversion of the insoluble asphaltenic portion of such charge stock into useful soluble hydrocarbon products. Crude petroleum oil, and other heavy hydrocarbon fractions and/or distillates, which boil at temperatures above the gasoline and middle-distillate boiling ranges, generally contain nitrogenous and sulfurous compounds in large quantities. In addition, these high-boiling black oils contain metallic contaminants which exhibit the tendency to exert detrimental effects upon any catalytic composite which may be utilized in a process to which the crude oil, or portion thereof, is subjected. The more common of such metallic contaminants are nickel and vanadium, although other metals including iron, lead, arsenic, copper, etc., may be present. Although the metallic contaminants may exist in a variety of forms, they are usually found as organo-metallic compounds of high molecular weight, such as metal porphyrins and various derivatives thereof. Notwithstanding that the total concentration of these metallic contaminants is relatively small, often less than about 10 ppm, calculated as the elemental metal, subsequent processing techniques are adversely affected thereby. For example, when a hydrocarbon charge stock containing metals in excess of about 10 ppm by weight is subjected to a cracking process for the purpose of producing lower-boiling, normally liquid hydrocarbons, the metals become deposited upon the catalyst employed, steadily increasing in quantity until such time as the composition thereof is changed to the extent that undesirable results are obtained.

In addition to the contaminating influences exemplified by nitrogenous and sulfurous compounds, and organo-metallic complexes, crude oils and other heavy hydrocarbon fractions generally consist of a significant quantity of high-boiling insoluble asphaltenic material. For example, a full boiling range Wyoming sour crude oil, having a gravity of 23.2 API at 60° F., not only is contaminated by about 2.8% by weight of sulfur, approximately 2,700 ppm of total nitrogen, a total of about 100 ppm of metallic porphyrins (computed as elemental nickel and vanadium), but contains a heptane-insoluble asphaltenic fraction in an amount of about 8.4% by weight. Similarly, crude tower bottoms product, having a gravity API at 60° F., of 14.3, is contaminated by the presence of about 3.0% by weight of sulfur, 3,800 ppm of total nitrogen, about 85 ppm of total metals and about 10.9% by weight of asphaltenic compounds. A much more difficult charge stock to convert into valuable, normally liquid hydrocarbons, is a vacuum tower bottoms product having a gravity/API at 60° F., of 7.0, and containing more than 6,000 ppm, of nitrogen, about 4.0% by weight of sulfur, over 450 ppm of metallic contaminants, and about 24.0% by weight of pentane-insoluble asphaltenic material. Asphaltenic material consists of high molecular weight hydrocarbons which are considered to be coke-precursors having the tendency to become immediately deposited within the reaction zone and other process equipment, and on to the catalytic composite in the form of gummy hydrocarbonaceous residue which effectively deactivates the catalyst with respect to its ability to perform the removal of sulfur and nitrogen by conversion thereof to hydrogen sulfide, ammonia and hydrocarbons. Furthermore, this in effect constitutes a large loss of charge stock and it is economically desirable to convert such asphaltenes into pentane-soluble liquid hydrocarbon products.

DESCRIPTION OF THE PRIOR ART

It must be recognized and acknowledged that the prior art abounds with a wide spectrum of techniques incorporated into the ancient process of solvent deasphalting (or solvent extraction) asphaltenic hydrocarbonaceous charge stocks. Likewise, a considerable amount of technology has been developed with respect to the catalytic slurry processing of hydrocarbonaceous black oils. In the interest of brevity, no attempt will be made herein to delineate exhaustively either the solvent deasphalting, or the slurry processing prior art. However, several illustrations of such prior art, including that directed toward combinations thereof, will be described briefly for the purpose of indicating the particular area to which our invention is intended to be applied.

Broad concepts of solvent deasphalting are disclosed in U.S. Pat. No. 2,081,473 (Cl. 208–14) issued May 25, 1937. Preferred solvents are indicated as being liquefied normally gaseous hydrocarbons including methane, ethane, propane, butane and mixtures thereof. An aromatic hydrocarbon modifier is employed in U.S. Pat. No. 2,882,219 (Cl. 208–86).

U.S. Pat. No. 3,998,726 (Cl. 208–309) issued Dec. 21, 1976, is directed toward the variation of utilizing a solvent extraction zone adapted with direct heating in the upper section thereof, as contrasted to the indirect heat-exchange facilities previously employed. Suitable hydrocarbon-selective solvents are again light hydrocarbons including ethane, propane, butane, isobutane, pentane, isopentane, neopentane, hexane, isohexane, heptane, mono-olefinic counterparts thereof, etc.

With respect to catalytic slurry processing of hydrocarbonaceous black oils, U.S. Pat. No. 3,165,463 (Cl. 208–264) issued Jan. 12, 1965, directs itself toward the use of an unsupported organo-metallic catalyst in which the metal is selected from Group V-B, VI-B and the iron-group of the Periodic Table. The catalyst-containing sludge, including asphaltenes, is in part recycled to combine with the charge stock. Nickel and vanadium values in the recycled sludge portion will be converted to the sulfides thereof, and thus supply at least part of the catalytic action in the reaction zone. One of the more apparently successful processes is that encompassed by the technique disclosed in U.S. Pat. No. 3,558,474 (Cl. 208–108) issued Jan. 26, 1971. Here the change stock is reacted with hydrogen in admixture with a finely divided non-stoichiometric vanadium sulfide catalyst. Also, up to about 90.0% of the catalyst- and asphaltene-containing sludge is recycled to combine with the fresh feed charge stock.

One combination of solvent deasphalting and catalytic slurry processing with an unsupported metal sulfide catalyst is shown in U.S. Pat. No. 3,723,294 (Cl. 208–86), issued Mar. 27, 1973. Here the charge stock, in admixture with the metal sulfide catalyst and the normally liquid portion of the effluent from the subsequent reaction zone, is first subjected to solvent deasphalting. The solvent-lean mixture of catalyst and precipitated asphaltic material is reacted with hydrogen to convert asphaltenes into lower-boiling hydrocarbon products. The solvent-rich, deasphalted oil-containing phase is introduced into a solvent recovery column from the bottom of which the DAO product and other distillates are recovered. Similarly, U.S. Pat. No. 3,723,297 (Cl. 208–95) issued Mar. 27, 1973 discloses the technique where the mixture of charge stock, asphaltenes and unsupported metal sulfide catalyst is first introduced into the reaction zone. Following separation of hydrogen, the product effluent passes into the deasphalting zone; again, the desired DAO product is recovered as a bottoms stream from the solvent recovery facility.

The foregoing is believed to be representative of the areas of petroleum refining to which our invention is intended to be applied.

OBJECTS AND EMBODIMENTS

An object of the present invention is to provide a process for hydrorefining or decontaminating petroleum crude oil and other heavy hydrocarbon fractions. A corollary object is to convert hydrocarbon-insoluble asphaltenes into hydrocarbon-soluble, lower boiling normally liquid products.

Another object is to effect removal of sulfurous and nitrogenous compounds by conversion thereof into hydrocarbons, hydrogen sulfide and ammonia. A specific object of our invention is to effect the continuous decontamination of asphaltenic black oils by providing a slurry process utilizing a solid, unsupported metal catalyst.

Therefore, in one embodiment, the invention described herein encompasses a process for the conversion of an asphaltene-containing, hydrocarbonaceous black oil in a catalytic slurry reaction zone wherein an admixture of converted hydrocarbonaceous oil, unreacted asphaltenes and a metal catalyst is recycled to the reaction zone.

In a more specific embodiment, the present invention directs itself toward a process for the conversion of an asphaltene-containing, hydrocarbonaceous black oil, and the recovery of deasphalted oil therefrom, which comprises the steps of: (a) reacting said black oil, hydrogen, a hereinafter described recycle stream comprising unreacted asphaltenes, a metal catalyst selected from the iron-group metals and the metals from Group V-B and VI-B, and a deasphalted oil in a reaction zone at conversion conditions selected to convert asphaltenic material into lower-boiling hydrocarbons: (b) separating the resulting reaction product effluent, in a gas-liquid separation zone, to provide a hydrogen-rich first vaporous phase and, a first liquid phase, containing metal catalyst and unreacted asphaltenes, and recycling at least a portion of said first vaporous phase to combine with said black oil; (c) deasphalting said first liquid phase with a hydrocarbon-selective solvent comprising a light hydrocarbon having from about 3 to about 9 carbon atoms per molecule in a solvent extraction zone to provide a solvent-rich second liquid phase, containing deasphalted oil, and, a solvent-lean mixtuure of unreacted asphaltenes and metal catalyst; (d) admixing at least a portion of said solvent-lean mixture of unreacteed asphaltenes and metal catalyst with at least a portion of said solvent-rich second liquid phase, containing deasphalted oil; (e) removing at least a portion of the hydrogen selective solvent from the admixture produced in step (d) in a solvent recovery zone to provide said hereinabove described recycle stream; (f) separating at least a portion of said solvent-rich second liquid phase in a second solvent recovery zone to provide a stream comprising said hydrocarbon-selective solvent, and recycling at least a portion of said stream to said solvent extraction zone and a substantially solvent-free deasphalted oil.

Other embodiments of our invention will become evident to those having the requisite skill in the appropriate art from the following more detailed description of our invention which includes particular operating conditions and techniques.

BRIEF SUMMARY OF THE INVENTION

The present invention relates to a process for the conversion of an asphaltene-containing, hydrocarbonaceous black oil in a catalytic slurry reaction zone wherein an admixture of converted hydrocarbonaceous oil, unconverted asphaltenes and a metal catalyst is recycled to the reaction zone.

BRIEF DESCRIPTION OF THE DRAWING

Briefly referring now to the accompanying drawing, which illustrates several embodiments of the present invention, the integrated process is presented by way of a simplified schematic flow diagram.

Many details including pumps, instrumentation and controls, heat-exchange and heat-recovery circuits, start-up lines, compressors, condensers, valving and similar hardware have been eliminated, or reduced in number as not being essential to or understanding of the techniques involved. The utilization of these miscellaneous appurtenances, for the purpose of modifying the process, is well within the purview of those possessing the requisite expertise in the appropriate technology.

The detailed description which follows will be made in conjunction with a commercially sized unit designed to process about 10,000 barrels per day of heavy Venezuelan crude having a gravity of about 5.9° API. Contaminants include 4.3 weight percent sulfur, 4500 ppm nitrogen, 10.2 weight percent heptane insolubles, 460 ppm vanadium and 108 ppm nickel. The initial boiling point is about 650° F., and 1050° F. is the 36% volumetric distillation temperature.

DETAILED DESCRIPTION OF THE DRAWING

Specifically referring now to the drawing, for the sake of simplification, the numerical values of the various liquid streams and components thereof will be given in barrels per day.

The black oil charge stock is introduced into the process by way of line 1 in an amount of about 10,000 barrels per day (BPD) in slurry admixture with about 5 weight percent of finely-divided vanadium sulfide, calculated as elemental vanadium, which vanadium sulfide is carried via line 9A. A hydrogen circulation stream is provided via line 5 to join the black oil in line 1 at a rate of about 15,000 standard cubic feet per barrel of fresh feed (SCFB FF). The fresh feed black oil, the finely divided vanadium catalyst, which is slurried in a recycle stream comprising unreacted asphaltenes, and converted hydrocarbonaceous oil and the circulating hydrogen are introduced in reaction zone 2 via line 1. Reaction zone 2 is maintained at a temperature in the range of about 700° F. to about 1000° F. and a pressure in the range of about 500 to about 4000 psig and preferably from about 1000 to about 3000 psig. The design of the internals of reaction zone 2 are not essential to our invention, and they may be constructed utilizing well-known devices such as disc and donut trays, side-to-side pans, etc. Similarly, in order to assure intimate mixing and contacting of the reactants, a variety of mechanical devices such as spray, nozzles, bayonets, distributing grids, etc. may be employed. Residence time within the reaction zone depends upon a multitude of considerations. Not the least of these considerations involve temperature, the degree of mixing, catalyst concentration, charge stock characteristics, the degree of conversion and the volumetric ratio of recycle material to fresh feed. In most applications of our invention, the residence time will range from about 10 minutes to about 3 hours.

The reaction zone effluent is withdrawn through line 3 and following its use as a heat exchange medium, if desired, is introduced thereby into gas separation zone 4 which is maintained at a temperature in the range of about 60° to about 140° F. A hydrogen-rich, vaporous phase is withdrawn from gas separation zone 4 by way of line 5 and recycled therethrough to combine with the charge stock in line 1. The recycled gaseous phase may be treated by any means well-known in the art for the purpose of removing, adding or adjusting the concentration of hydrogen sulfide and any other gaseous components in order to increase the concentration or volume of hydrogen or any other gaseous components. It is needless to say that in a process such as this one where there is a positive consumption of hydrogen, make-up hydrogen must be supplied to the process from an external source and such details are readily achieved by those skilled in the hydroprocessing art. A liquid phase is withdrawn from gas separation zone 4 via line 6, is admixed with an isobutane deasphalter solvent which is supplied via line 12 and 9C and the resulting admixture is introduced into solvent extraction zone 7. A stream containing a deasphalted oil together with isobutane deasphalter solvent is withdrawn from solvent extraction zone 7 via line 8. A portion of the deasphalted oil and isobutane deasphalter solvent admixture is transmitted to a first solvent recovery zone 9B via lines 10 and 9. A heavy liquid hydrocarbon stream containing unconverted asphaltenes and finely divided metal catalyst particles is recovered from solvent extraction zone 7 via line 9 and is transported to a first solvent recovery zone 9B via line 9. An isobutane deasphalter solvent stream is recovered from first solvent recovery zone 9B via line 9C and which is recycled to the solvent extraction zone via line 9C and 6. A recycle stream comprising unreacted asphaltenes, converted hydrocarbonaceous oil and a metal catalyst is recovered from first solvent recovery zone 9B via line 9A and is recycled to reaction zone 2 via lines 9A and 1.

A portion of the stream containing a deasphalted oil and isobutane deasphalter solvent which is recovered from solvent extraction zone 7 is introduced into a second solvent recovery zone 11 via line 8. An isobutane deasphalter solvent stream is recovered from second solvent recovery zone 11 via line 12 and which is recycled to the solvent extraction zone 7 via line 12 and 6. A deasphalted oil or product stream is removed from second solvent recovery zone 11 via line 13.

DETAILED DESCRIPTION OF THE INVENTION

Previously, processes utilizing slurry metal catalyst for the conversion of hydrocarbonaceous black oils have recycled unconverted asphaltenes and high molecular weight resins from the solvent extraction zone to the reaction section. The earlier processes employed relatively mild reaction zone conditions in order to minimize reactor deposition and therefore the amount of asphalt or unconverted asphaltenes and high molecular weight resins is often equal in volume to the fresh feed. This results in an extremely high concentration of asphaltenes in the reactor section which in itself may contribute to reactor deposition and which raises the average molecular weight of the liquid and reduces the hydrogen to carbon ratio of the liquid and lowers the solubility by weight of hydrogen in the liquid. Both of these latter conditions have an adverse effect on the conversion of asphaltenes in the reaction zone.

Our improved method of operation of a slurry metal catalyst black oil conversion process solves the hereinabove mentioned difficulties without increasing the amount of overall recycle material and, in fact, increases product quality and greatly reduces high viscosity problems arising from handling almost pure asphaltenes in both the recycling and drag stream operations.

In order to increase the hydrogen to carbon ratio in the reaction zone and make the recycle stream have characteristics similar to the fresh feed, a stream of deasphalted hydrocarbon is recycled to the slurry catalyst containing stream which is recovered from the solvent extraction zone. It is preferable that the deasphalted hydrocarbon stream be recycled before the removal of the deasphalting solvent and a suitable source of this admixture of deasphalted hydrocarbon stream and deasphalting solvent is the solvent rich stream which is recovered from the solvent extraction zone.

Most slurry metal catalyst black oil conversion processes utilize a system to remove what is a commonly referred to as a "drag stream". Such a drag stream usually is a small slip stream of the heavy hydrocarbonaceous stream which is recovered from the solvent extraction zone and contains asphaltenes, unconverted black oil feedstock and finely divided metal catalyst and serves as a purge to prevent excessive build-up of accumulated metal and highly refractive hydrocarbons which are produced. Subsequently, the components of the drag stream are salvaged if economically feasible.

An additional benefit may be realized by the method of our invention if the deasphalted oil is recycled to the heavy hydrocarbonaceous stream containing the finely divided catalyst before the drag stream is removed. Then the drag stream will be much easier to handle in terms of heat exchange, and oil and metal recovery therefrom by solvent treatment or by any other means. It is further expected that due to the greater conversion of asphaltenes made possible by the improved reaction system, the amount of drag stream taken to maintain equilibrium will be no greater than conventionally removed.

The particular finely divided, solid catalyst utilized in the present slurry process, is not considered to be essential. However, it must be recognized that the catalytically active metallic component of the catalyst necessarily possesses both cracking and hydrogenation activity. In most applications of our invention, the catalytically active metallic component or components will be selected from the metals of Group V-B, VI-B and VIII of the Periodic Table. Thus, in accordance, with The Periodic Table of The Elements, E. H. Sargent and Company, 1964, the preferred metallic components are vanadium, chromium, iron, cobalt, nickle, niobium, molybdenum, tantalum and/or tungsten. The noble metals of Group VIII, namely ruthenium, rhodium, palladium, osmium, iridium, and platinum, are not generally considered for use in a slurry-type process in view of the economic considerations involved with these relatively expensive metals. The foregoing metallic components may be combined with a refractory inorganic oxide carrier material and the final composite being reduced to a finely divided state. In such a composite, the active metallic components may exist in some combined form such as the oxide, sulfide, sulfate, carbonate, etc. Recent investigations and developments in catalytic slurry processing of heavy hydrocarbon charge stocks have indicated that the sulfides of the foregoing metals, and particularly those of Group V-B, offer more advantageous results. Furthermore, the process appears to be facilitated when the sulfide of the metal is unsupported, as contrasted to being combined with a refractory inorganic oxide carrier material. For this reason, the preferred unsupported catalyst for use in the process of the present invention, comprises tantalum, niobium or vanadium with a vanadium sulfide being particularly preferred. Generally, the slurry metal catalyst is present in the reaction zone in amount of about 0.1 to about 10 percent by weight, calculated as the elemental metal.

Regardless, of the character of the catalyst, it may be prepared in any suitable, convenient manner with the precise method not being essential to the present invention. For example, vanadium sulfides may be prepared by reducing vanadium pentoxide with sulfur dioxide, sulfuric acid and water to yield a solid hydrate of vanadyl sulfate. The latter is treated with hydrogen sulfide at a temperature of about 300° C. to form vanadium tetrasulfide. Reducing the vanadium tetrasulfide in hydrogen, at a temperature of above about 300° C. produces the vandium sulfide which is slurried into the system. The concentration of vanadium sulfide is preferably within the range of about 0.1 to about 10 weight percent and more preferably between about 1 and about 6 weight percent, calculated as the elemental metal. Excessive concentrations do not appear to enhance the results, even with extremely contaminated charge stocks having exceedingly high asphaltene contents.

In order to promote the conversion of asphaltenes to lower boiling hydrocarbons, the removal of sulfur, nitrogen and metal from hydrocarbons and the general hydrogenation of feed to the reaction zone, it is necessary that a sufficient supply of hydrogen is present in the reaction zone. Hydrogen is supplied at a rate from about 1000 to about 50,000 SCFB based on fresh feed and preferably at a rate of about 5000 to about 25,000 SCFB.

In the solvent extraction zone, the deasphalter solvent is preferably supplied at a rate to provide a solvent to product oil volume ratio of from about 3 to about 10. Depending on the type of black oil being processed, the ratio of solvent to oil is adjusted to give the desired extraction zone separation while at the same time avoiding the luxury of circulating excessive quantities of the deasphalter solvent. The operating pressures and temperature employed in the solvent extraction zone are generally those employed and taught in the conventional deasphalting art. Suitable pressure and temperature for solvent extraction include a pressure from about atmospheric to about 1500 psig and a temperature from about 100° F. to about 600° F.

The recycle stream containing an admixture of converted hydrocarbonaceous oil, unconverted asphaltenes and metal catalyst is preferably recycled at a rate sufficient to provide a ratio of black oil fresh feed to said recycle stream of from about 0.01 to about 20. However, it must be realized that all ratios will not necessarily demonstrate the same results. The quantity of this recycle stream is more ably determined by the quantity of slurry metal catalyst required and the degree of asphaltenic conversion achieved in the reaction zone.

Any suitable method or technique may be utilized in the solvent recovery zones to recover the deasphalter solvent. The prior art is replete with equipment, flow schemes, operating conditions including pressure, temperature, etc. and any further detailed explanation is without purpose. Furthermore, the operation of the solvent recovery zone per se is not critical to the operation of the present invention.

The following example is presented in illustration of a preferred embodiment of the present invention and is not intended as an undue limitation on the generally broad scope of the invention as set out in the appended claims.

EXAMPLE

The fresh feed chargestock is 10,000 barrels per day (BPD) of a heavy Venezuelan Crude having a gravity of 5.9° API, a sulfur concentration of 4.35 weight percent, an initial boiling point of 650° F., 460 ppm vanadium, 108 ppm nickel and a heptane insoluble level of 10.2 weight percent.

The charge stock is admixed with a hydrogen circulation stream which is equivalent to 15,000 SCFB FF, a recycle stream containing an admixture of unconverted asphaltenes, slurried metal catalyst particles in an amount to provide a vanadium catalyst concentration of 3 weight percent based on the elemental metal and the weight of the black oil fresh feed and converted hydrocarbonaceous oil in an amount of about 5000 barrels per day.

This resulting admixture is subjected to conversion conditions which include a temperature of 780° F. and a pressure of 3000 psig in a reaction zone. The average residence time in the reaction zone is about 60 minutes. The reaction zone effluent is separated at a temperature of about 450° F. to yield a vaporous stream containing hydrogen and light hydrocarbons which is further cooled to about 120° F. to recover light hydrocarbons in an amount of about 500 BPD and hydrogen rich gas which is recycled to the inlet of the reaction zone. This gas separation step also yields a heavy hydrocarbon liquid stream which is cooled and contacted with an isopentane deasphalting solvent at a solvent to product oil ratio of about 4 at a temperature of about 330° F. The resulting admixture is introduced into a solvent extraction zone which yields a stream of deasphalted oil together with isopentane deasphalter solvent and a heavy liquid hydrocarbon stream containing asphaltenes and finely divided vanadium catalyst particles. A portion of each of the hereinabove described streams is admixed and charged to a solvent recovery zone to provide a recycle deasphalting stream which is charged to the hereinabove described solvent extraction zone and a recycle steam is hereinabove described which is introduced into the reaction zone. A drag stream comprising asphaltenes and finely divided vanadium catalyst is withdrawn from the process in an amount of about 250 BPD.

The isopentane is recovered from the deasphalted oil in a second solvent recovery zone to provide a deasphalted oil product of about 9500 BPD and a recycle deasphalting solvent stream which is introduced to the hereinabove described solvent extraction zone.

The foregoing specification and example indicate the method by which the present invention is effected and illustrates the benefits to be afforded through the utilization thereof.

I claim:

1. A process for the conversion of an asphaltene-containing, hydrocarbonaceous black oil, and the recovery of deasphalted oil therefrom, which comprises the steps of:

(a) reacting said black oil, hydrogen, a hereinafter described recycle stream comprising unreacted asphaltenes, a metal catalyst selected from the iron-group metals and the metals from Group V-B and VI-B, and a deasphalted oil in a reaction zone at conversion conditions selected to convert asphaltenic material into lower-boiling hydrocarbons;

(b) separating the resulting reaction product effluent, in a gas-liquid separation zone, to provide (i) a hydrogen-rich first vaporous phase and, (ii) a first liquid phase, containing metal catalyst and unreacted asphaltenes, and recycling at least a portion of said first vaporous phase to combine with said black oil;

(c) deasphalting said first liquid phase with a hydrocarbon-selective solvent comprising a light hydrocarbon having from about 3 to about 9 carbon atoms per molecule in a solvent extraction zone to provide (i) a solvent-rich second liquid phase, containing deasphalted oil, and, (ii) a solvent-lean mixture of unreacted asphaltenes and metal catalyst;

(d) admixing at least a portion of said solvent-lean mixture of unreacted asphaltenes and metal catalyst with a portion of said solvent-rich second liquid phase, containing deasphalted oil;

(e) removing at least a portion of the hydrocarbon selective solvent from the admixture produced in step (d) in a solvent recovery zone to provide said hereinabove described recycle stream; and (f) separating a portion of said solvent-rich second liquid phase in a second solvent recovery zone to provide (i) a stream comprising said hydrocarbon-selective solvent, and recycling at least a portion of said stream to said solvent extraction zone and (ii) a substantially solvent-free deasphalted oil.

2. The process of claim 1 wherein said reaction zone is maintained at a temperature from about 700° F. to about 1000° F.

3. The process of claim 1 wherein said reaction zone is maintained at a pressure from about 500 psig to about 4000 psig.

4. The process of claim 1 wherein the average residence time in said reaction zone is from about 10 minutes to about 3 hours.

5. The process of claim 1 wherein said reaction zone hydrogen is supplied at a rate from about 1000 to about 25,000 SCFB FF.

6. The process of claim 1 wherein the volume ratio of said recycle stream comprising unreacted asphaltenes, a metal catalyst selected from the iron-group metals and the metals from Group V-B and VI-B and a deasphalted oil to black oil fresh feed is from about 0.1 to about 10.

7. The process of claim 1 wherein said metal catalyst is present in the reaction zone in an amount of about 0.1 to about 10 percent by weight, calculated as the elemental metal.

8. The process of claim 1 wherein the solvent to oil volume ratio in the solvent extraction zone is from about 3 to about 10.

* * * * *